United States Patent [19]

Erismann

[11] 4,389,431

[45] Jun. 21, 1983

[54] PROCESS FOR MECHANICALLY DEPOSITING HEAVY METALLIC COATINGS

[75] Inventor: David W. Erismann, Cottage Grove, Minn.

[73] Assignee: Minnesota Mining and Manufacturing Company, Saint Paul, Minn.

[21] Appl. No.: 393,737

[22] Filed: Jun. 30, 1982

Related U.S. Application Data

[60] Continuation-in-part of Ser. No. 230,861, Feb. 2, 1981, abandoned, which is a division of Ser. No. 148,732, May 12, 1980, abandoned.

[51] Int. Cl.[3] ..... B05D 3/12

[52] U.S. Cl. ..... 427/242; 106/1.17; 427/406

[58] Field of Search ..... 427/242, 405, 406, 436; 106/1.17

[56] References Cited

U.S. PATENT DOCUMENTS

| | | | |
|---|---|---|---|
| 3,328,197 | 6/1967 | Simon | 427/242 |
| 3,400,012 | 9/1968 | Golben | 427/242 |
| 3,531,315 | 9/1970 | Golben | 106/1.17 X |

*Primary Examiner*—Evan K. Lawrence

*Attorney, Agent, or Firm*—Cruzan Alexander; Donald M. Sell; Gerald F. Chernivec

[57] ABSTRACT

A mechanical plating process utilizes a chemical promotor system for providing heavy, thick metallic coatings on articles, the system comprising a flash promotor for providing a thin, adherent flash coating on the articles and a continuing promotor for incremental addition together with the finely divided mechanical plating metal to form the heavy, thick coatings.

5 Claims, No Drawings

PROCESS FOR MECHANICALLY DEPOSITING HEAVY METALLIC COATINGS

This is a continuation-in-part of application Ser. No. 230,861, filed Feb. 2, 1981, abandoned, which is a division of application Ser. No. 148,732, filed May 12, 1980, abandoned.

TECHNICAL FIELD

This invention relates to a process for the plating of metals on a substrate by application of mechanical forces to particulate malleable metals and mixtures and alloys thereof, typically termed "mechanical plating".

BACKGROUND ART

It has been known in the art to plate metals upon a substrate, usually itself metal, by applying to plating metals, in particulate form, mechanical forces sufficient to produce such a close association of the plating metal particles and the surface of the article to be plated that adhesion occurs between the article surface and the plating metal particles. To produce the mechanical forces necessary to provide such adhesion, typically the plating metal particles, a solid impacting media and materials which have been found to be effective in the promoting of such plating are placed in a ball mill or tumbling barrel and rotated together. In this manner, the kinetic energy of the moving impacting media is transferred to the plating metal particles in a fashion such that these particles are hammered or pounded by the impacting media onto the surfaces of the articles to be plated.

The initial work in this field of mechanical plating, as described above, has been undertaken by Clayton and Pottberg, such work being discussed in U.S. Pat. Nos. 2,640,001; 2,640,002; Re. 23,861; 2,689,808; 2,723,204, etc. Typically, the aforementioned processes are undertaken in the presence of a liquid, and the agitated conglomerate or slurry contains what are commonly referred to as "promoter chemicals". Such promoter chemicals typically comprise unsaturated fatty acids and the like, film-forming materials and surfactants.

Further patents, such as U.S. Pat. No. 3,460,977, discuss the use of other promoter chemicals for effectuating the mechanical plating discussed above. In U.S. Pat. No. 3,328,197, there is taught a further improvement wherein the promoter chemical is provided in a solid cake or bar which contains a predetermined desirable combination of mechanical plating promoter chemicals. As the mechanical plating cycle progresses, the bar or cake dissolves at a rate which provides sufficient promoter chemical to optimize the mechanical plating process.

In U.S. Pat. No. 3,268,356 there is disclosed another refinement or improvement, wherein the promoter chemical and/or the plating metal particles are added to the plating barrel incrementally in successive additions, which is taught to optimize the density and uniformity of the plating over the entire surface of the article being plated.

A substantial breakthrough in mechanical plating is disclosed in U.S. Pat. No. 3,531,315, where it is disclosed that a composition containing a strong acid could be utilized during the mechanical plating process, thereby eliminating a costly and time consuming rinsing step which had been necessary prior to that discovery. In essence, the strong acid employed for cleaning and scale removal of the articles to be plated was also utilized during the mechanical plating process without necessity of an intervening rinsing step.

Gradually, it became desirable to increase the thickness and coating weight of mechanically applied metallic coatings, e.g., up to from about 0.7 to 2.5 ounces per square foot coating weight (1.5 to 5.3 mils coating thickness). During the development of such heavy coatings, it was found that the teachings of U.S. Pat. No. 3,268,356 were applicable in that incremental additions of metal powder enhanced the adhesion of plated deposits. Therefore, the commonly utilized citric acid-based chemistry, such as, for example, is discussed in U.S. Pat. No. 3,328,197, was amenable for use therewith. The operating pH of about 3.0 to 3.5 with this chemistry is less aggressive upon the metal powder, and also, the promoter chemicals could be introduced in bar form which slowly disintegrated during the process, thereby releasing the chemicals gradually as plating progressed. However, the relative high cost of organic acids and their salts, together with their known tendency to complex heavy metal ions to preclude or hamper effective effluent treatment made their use less than desirable economically.

Even though this system would function to provide heavy coatings on articles, it was therefore still desirable to optimize processing time in accordance with the teachings of U.S. Pat. No. 3,531,315, i.e., wherein a separate cleaning and rinsing step could be eliminated. However, the commercially available chemistry normally utilized with the process of the patent is not amenable to incremental metallic powder additions, as was the citric acid-based system, because the operating pH of this system, being in the range of 0.5 to 1.5, is typically too aggressive upon the metal powder. Furthermore, in this latter process, promoter chemicals are typically introduced in powder form at the start of the plating cycle with no intervening additions during the process. Typically, therefore, during a plating cycle utilizing this promoter chemistry in conjunction with incremental metallic powder additions, the metallic coating may not be deposited in a controlled fashion since the proper chemical environment would not be continually present during the entire plating cycle. Consequently, the conditions necessary to apply successive layers of well consolidated, adherent particlss could not be uniformly maintained.

While it has been desirable to utilize the processing techniques of U.S. Pat. No. 3,531,315 because such are typically based on a non-chelating and more economical acid system, such has not heretofore been available for the production of higher coating weights. However, I have now found a chemical composition system which is more amenable to utilization with incremental metal powder additions during the mechanical plating of higher coating weights. The system is utilized at the initiation of the plating cycle as well as during the plating cycle by incremental addition in conjunction with the metal powder.

SUMMARY OF THE INVENTION

In accordance with the invention there is provided a mechanical plating process which utilizes a chemical promoter system capable of being used in conjunction with finely divided mechanical plating metal, water, and impact media in a mechanical plating process to provide thick metallic coatings on articles. The promoter system comprises a flash promoter which comprises, per 100 square feet of plating surface area, up to about 400 grams of a strong acid or and acid engendering salt, from about 10 to about 80 grams of a soluble salt of a metal which is more noble that the plating metal, an effective amount of a dispersant capable of dispersing the plating metal, and an effective amount of an inhibitor capable of inhibiting corrosion of the plating metal, together with a continuing promoter which comprises, per pound of finely divided mechanical plating metal, from about 20 to about 150 grams of a strong acid or an acid engendering salt, from about 1.0 to about 20 grams of a soluble salt of a metal which is more noble than the plating metal, an effective amount of a dispersant capable of dispersing the plating metal, and an effective amount of an inhibitor capable of inhibiting corrosion of the plating metal.

The flash promoter, during the mechanical plating process, provides a thin adherent flash coating of a metal more noble than the plating metal on the articles to be plated, following which the continuing promoter is incrementally added to the process in conjunction with incremental additions of the finely divided mechanical plating metal until a thick metallic coating of the plating metal is built up on the articles to be plated.

DETAILED DESCRIPTION

I have ascertained that it is extremely important to provide a proper chemical balance during the entire plating cycle in order to insure a proper pH to effectively clean the finely divided mechanical plating metal and to provide an optimal environment for plating to occur. Based on my experience, I devised a process utilizing a chemical promoter system which is extremely effective in the production of higher coating weights. It is divided into two basic promoter compositions, the first being referred to as the "flash promoter" and the second being termed the "continuing promoter". The flash promoter is utilized to provide a thin adherent coating by galvomechanical means, in accordance with the teachings of U.S. Pat. No. 3,400,012, as well as initial quantities of other plating components as hereinafter defined. Because this promoter's function is to provide this coating over the entire surface of the articles to be plated, same is added proportional to the surface area of the articles to be coated.

The continuing promoter's function is to provide a proper chemical environment for the mechanical plating process to occur. This includes a proper pH such that the surfaces of the finely divided mechanical plating metal is clean, but there is insubstantial dissolution of the metal in the plating solution, prevention of agglomeration of the finely divided metal to insure a proper plating rate and uniform coating thicknesses. Therefore, the concentration of components in this promoter is dependent upon the quantity of finely divided mechanical plating metal to be deposited.

During my initial experimentation to determine an effective promoter system, I observed that the adhesion of the mechanical plating immediately after cessation of the plating process was quite low, requiring minimal abrasive handling of the coated articles. After about seven days, however, the coatings became quite strong. In further experimentation conducted to reduce this time required for obtaining optimal coating strength, it was found that by heating the coating to an elevated temperature of from about 120° C. to 175° C. for from about 10 to 15 minutes, coating strengths similar to those obtained after seven days at room temperature resulted. However, I also ascertained that the mechanical plating lost adhesion when the aforementioned heating step was undertaken, resulting in flaking off of the coating. I ascertained that by including in the continuing promoter a soluble salt of a metal more noble that the mechanical plating metal completely eliminated this lack of adhesion problem. The exact reason why the inclusion of this soluble salt in the continuing promoter which is added incrementally in conjunction with the finely divided plating metal is unknown, although it is assumed that an effect similar to that disclosed in U.S. Pat. No. 3,400,012 is obtained.

Exemplary soluble salts of metals more noble than the finely divided plating metal include cadmium, lead, and preferably, tin, e.g., stannous chloride, stannous sulfate, stannous fluoborate, etc. In my flash promoter, this salt should be included at a concentration level of from about 10 to about 80 grams per 100 square feet of surface area to be plated, with about 30 grams being preferred. In my continuing promoter, the concentration thereof should be from about 1.0 to about 20 grams per pound of finely divided plating metal charged during the incremental steps of the plating cycle, with about 10 grams being preferred. At low concentrations, a reduction of a adhesion of the metallic plating, as aforementioned, is exhibited. The upper concentration limit is maintained in terms of economics, as opposed to functionality, the cost thereof becoming excessive relative to additional benefit provided thereby.

The next component which is useful in this mechanical plating process is a strong acid or an acid engendering salt. This acidity is typically utilized in the processing to remove metal oxides contained on the finely divided mechanical plating metal and the articles to be plated. Typical strong acid engendering salts include potassium or ammonium bisulfate, sulfamic acid, etc., with the preferred being sodium bisulfate. Relative to the flash promoter, the concentration of the acid engendering salt or acid component can be included therein up to about 400 grams per 100 square feet of plating surface charged. In essence, one can choose to derive all acidity relative to the flash promoter from surface conditioning chemicals which are conventionally used in the mechanical plating processes and which are strongly acidic. By use of same, one eliminates the acid carrier in the flash promoter.

In the continuing promoter, the acid engendering salt or strong acid should be utilized in a range of from about 20 to about 150 grams per pound of finely divided plating metal charged to the plating operation. While an acid engendering salt is preferred, because same can act as a carrier for the other components of the promoter chemistry, sulfuric acid or other strong acids can also be utilized to provide acidity, as necessary, as mechanical plating occurs.

The next component having utility in my invention is a dispersant, same being typically utilized to disperse the metal particles charged to the plating run to prevent their premature agglomeration.

Materials capable of functioning effectively for dispersing the plating metal powders include polyoxyethylene glycols having a cloud point in a 1 percent aqueous solution below 100° C., such as "Carbowax" 20M (available from the Union Carbide Chemicals Company), or "Polyglycol E50,000" (available from the Dow Chemical Company); quaternary aliphatic ammonium salts such as "Arquad" S-2C (available from the Armour Industrial Chemical Company; proteinaceous materials such as "Technical Protein Colloids" No. 185, 169, or 70 (available from Swift & Company); among other materials which are disclosed in U.S. Pat. No. 3,531,315.

Additives which function as dispersants are typically related to both the specific acid and the specific finely divided plating metal involved. For example, effective dispersants for zinc powder in sulfuric acid include "Carbowax" 20M and "Orzan" AH-3, which is a salt of a polymerized alkyl aryl sulfonic acid, commercially available from the Crown Zellerbach Company; dispersants for zinc or tin particles in hydrochloric acid include "Nalquat" G-8-11 (which is a hydrophilic heterocyclic adduct of a hydrophilic alkyl compound containing nitrogen groups, commercially available from Nalco Chemical Company). Many other examples could, of course, be cited.

Whether a give component will function satisfactorily for dispersing specific plating metal particles in a specific acid can be determined by adding from about 0.25 to about 0.5 grams of the material to 250 milliliters of the acid plating solution in a 400 milliliter beaker, adding 10 grams of finely divided plating metal, stirring vigorously, and allowing the beaker and its contents to stand for 5 minutes. An effective dispersant will keep the plating metal in suspension, thereby rendering the acid plating solution opaque.

In the case of the preferred dispersant, that being "Carbowax" 20M, it has been found that the flash promoter can contain up to about 40 grams per 100 square feet of plating charge, with about 20 grams being preferred, while the continuing promoter can contain up to about 8 grams per pound of metal powder charged with about 3.5 grams being preferred.

The next component having utility in my invention is an inhibitor, same being typically utilized to inhibit corrosion of the plating metal by the acidic component, thereby preventing undesirable gassing and allowing the plating metal to perform its intended function.

In many instances, the inhibitor component is capable of functioning itself as a dispersant, and the aforementioned dispersant is not necessary. However, optimum benefits have been found to be achieved by utilizing a dispersant in conjunction with an inhibitor. Among materials capable of functioning as an effective means for inhibiting the corrosion of at least some plating metal in at least some acid plating solutions are compounded cationic amine inhibitors, such as "Armohib" 25 (available from the Armour Industrial Chemical Company); cationic inhibitors such as Inhibitor GC (available from the Sinclair Mineral and Chemical Company); and other materials as are described in U.S. Pat. No. 3,531,315. A preferred inhibitor is designated Additive "R"*.

*Additive "R" is a product made as follows: to 23.4 grams of dehydroabietyl amine (Amine D, available from Hercules Chemical Company) was slowly added 7.5 grams of acetophenone, with stirring; 10 grams of 20 Be HCl solution in water was added slowly in the same manner. Next, 9.7 grams of 37% formaldehyde was added in small increments and the mixture refluxed intermittently at 80° C. over a period of 3 days. At this point, 25.0 grams of acetone was added directly and 9.5 grams of 37% formaldehyde added incrementally, continuing to reflux for an additional 24 hours. The solution was evaporated to leave a solid material, 0.82 gram of which was dissolved in 0.66 gram of a 70:15:15 isopropanol:acetone:methanol solvent. In 0.42 gram of water, 0.82 gram of nonionic polyoxyethylene adduct of nonyl phenol ("Tergitol" NP-35, available from Union Carbide Chemicals Company) was dissolved, and the two solutions mixed together.

A test to ascertain the effective inhibitor for a particular system can be undertaken utilizing the test indicated above relative to a dispersant. An effective corrosion inhibitor, utilizing this test, will essentially prevent both gassing and clumping of the plating metal powder into tough balls. As to the preferred inhibitor, Additive "R", up to about 12 grams per 100 square feet of plating charge can be included in the flash promoter, with about 8 grams being preferred, and up to about 1.0 gram per pound of plating metal charged, with about 0.35 gram being preferred, has been found to provide satisfactory results in the continuing promoter.

The optimum amount of a given dispersant or inhibitor is, of course, related to the specific system in which it is used. In general, however, large volumes of liquid, open barrels, or highly acidic conditions, typically require more inhibitor than small volumes of liquid, closed barrels, or less acidic conditions. Similarly, the optimum concentration of dispersant decreases as the pH rises or as the weight of plating metal particles decreases.

In operation, the promoter chemistry as well as the plating metal additions are added at appropriate intervals during the plating cycle. The amount of plating metal added and the frequency of such additions are dependent upon the ultimate coating weight or thickness desired and the size, weight, and geometry of the articles to be plated. Additionally, the ratio of articles to impact media, the size of the plating barrel, and rotational speed thereof can have an affect upon the number and frequency of such addition. Typically, it has been determined that the initial chemistry be provided in the flash promoter with subsequent chemical additions added as the continuing promoter along with the plating metal addition. The flash promoter is added to the plating mixture subsequent the preferred conventional deposition of copper on the articles to be plated. Then, a small amount of finely divided plating metal is introduced to provide a galvanomechanical deposit upon the articles, as is discussed in U.S. Pat. No. 3,400,012. As is taught therein, the addition of the finely divided driving metal (termed herein plating metal) causes the galvanomechanical deposition on the articles of the more noble metal from the soluble salt thereof introduced with the flash promoter. As is also taught therein, the amount of finely divided metal should be sufficient to supply the number of electrons to reduce all of the metal salt ions, i.e., to effect the galvanomechanical deposition of the metal more noble than the finely divided metal.

After a sufficient period of time to allow the galvanomechanical deposition, generally from about 3 to about 5 minutes, a sufficient quantity of plating metal to provide a predetermined coating weight or thickness thereof can be added to the plating mixture. The introduction rate of the metal power to the plating mixture, which is again dependent upon the aforementioned factors, will typically be 1/30 of the total plating metal quantity required, with an addition being every 1 to 1.5 minutes. With each addition of metal, the appropriate quantity of continuing promoter is added simultaneously therewith.

After approximately ten such additions, the quantity of plating metal can be increased to about 1/12 the total amount thereof required, and each increment can be added at approximately 3 to 4 minute intervals, again with the corresponding quantity of necessary chemistry. After about 8 such additions, the plating cycle can be continued for an additional 3 to 5 minutes at which time the plated articles can be rinsed, separated from the impact media and dried.

Generally, lighter part types to be plated require fewer additions, over longer time periods, while heavier part types require increased additions at more frequent intervals.

My invention will now be more specifically described by the use of the following non-limiting examples, wherein all parts are by weight unless otherwise specified.

EXAMPLE 1

A 1,160 pound load of ¾ by 2½ inch bolts (232 square feet of plating surface) was precleaned in an inhibited sulfuric acid-based cleaner containing surfactants and placed in a 60 cubic foot multi-sided barrel having an angle of approximately 20° above horizontal rotating at 10 RPM's, together with an equal volume of glass beads of various sizes (4 parts 3.5 to 5 mesh, 2 parts 8–10 mesh, 1 part 14–30 mesh, and 1 part 40–70 mesh), the glass beads functioning as impact media. To the mixture, sufficient 24° C. (75° F.) water was added such that a puddle was formed having a width of 6 to 12 inches while the barrel was rotating, thereby providing a free flowing mixture.

To this mixture, 1688 grams of an inhibited acid solution containing 99.7 parts 66° Be sulfuric acid and 0.3 parts Additive "R" were added and allowed to mix for 2 minutes. An additional 663 grams of a solution containing 43.9 parts 66° Be sulfuric acid, 23.1 parts cupric sulfate pentahydrate and 33.0 parts sodium chloride were added to the mixture to promote a uniform thin copper deposit upon the ferrous metal parts.

After five minutes, 304 grams of a mixture containing 55.9 parts sodium bisulfate, 15.1 parts Carbowax 20M, 23.0 parts stannous chloride, and 6.0 parts Additive "R" were added to the barrel. After dispersing for a period of two minutes, 142 grams of zinc powder having a mean particle size of 8 microns was added to the mixture to initiate a flash coating of tin by galvanomechanical means. After 5 minutes, 23 pounds of zinc powder having a mean particle size of 8 microns was added incrementally to the contents of the barrel, utilizing ten increments of 350 grams each, at 1.5 minute intervals following by eight zinc powder increments of 870 grams each at 3 minute intervals. Each increment was added together with the following mixture, based on the weight of zinc added:

Sodium Bisulfate: 13.44 grams/100 grams of zinc
Additive "R": 0.15 grams/100 grams of zinc
Carbowax 20M: 0.73 grams/100 grams of zinc
Stannous Chloride: 2.2 grams/100 grams of zinc Following completion of the plating cycle, the metallic coating of zinc was found to have a uniform thickness by magnetic thickness testing, good appearance and excellent adhesion by conventional tape peel testing. The thickness was from 2.4 to 2.6 mils (60 to 65μ).

EXAMPLE 2

Example 1 was duplicated with the exception that the following mixture was added incrementally with the zinc powder:

Sodium Bisulfate: 14.76 grams/100 grams of zinc
Carbowax 20M: 0.37 grams/100 grams of zinc
Stannous Chloride: 1.48 grams/100 grams of zinc The thickness was measured and determined to be from 2.9 to 3.1 mils (72 to 78μ).

EXAMPLE 3

Example 1 was duplicated with the exception that the following mixture was utilized in incremental addition with the metallic zinc powder:

Sodium Bisulfate: 29.52 grams/100 grams of zinc
Carbowax 20M: 0.77 grams/100 grams of zinc
Stannous Chloride: 2.95 grams/100 grams of zinc The resultant coating exhibited excellent adhesion and uniform appearance. The thickness, as measured, was found to be 2.8 to 3.3 mils (70 to 82μ).

EXAMPLE 4

A precleaned, as in Example 1, 200 pound load of ¾ by 2½ inch bolts (40 square feet of plating surface) was placed in a 12 cubic foot multi-sided barrel having an angle of approximately 30° above horizontal rotating at 12 RPM's, together with an equal volume of glass beads of various sizes, as in Example 1.

To the mixture, 301 grams of an inhibited acid solution containing 99.7 parts 66° Be sulfuric acid and 0.3 parts Additive "R" were added and allowed to mix for 2 minutes. Then 116 grams of a solution containing 43.9 parts 66° Be sulfuric acid, 23.1 parts cupric sulfate pentahydrate, and 33.0 parts sodium chloride were added to promote a thin uniform copper deposit on the articles to be plated. After 5 minutes, 57 grams of a mixture containing 64.9 parts sodium bisulfate, 5.3 parts Additive "R", 1.8 parts Additive "A" and 28.0 parts stannous chloride were added to the barrel. After mixing for 2 minutes, 29 grams of zinc powder were added to initiate a thin flash coating.

After 5 minutes, 4.3 pounds of zinc powder was added incrementally to the contents of the barrel as follows: ten increments of 65 grams each at one minute intervals, then eight increments of 163 grams each at 3 minute intervals. Each increment was added together with the following mixture based on the weight of zinc added:

Sodium Bisulfate: 31.94 grams/100 grams of zinc
Additive "R": 0.15 grams/100 grams of zinc
Stannous Chloride: 1.1 grams/100 grams of zinc After deposition of the metal powder, the resultant coating was found to have a uniform appearance and excellent adhesion. The thickness as measured was 2.5 mils (62).

EXAMPLE 5

A precleaned, as in Example 1, 6 pound load of 5/16 by ¾ inch bolts (500 square inches of plating surface) was placed in a 0.3 cubic foot open end multisided barrel having an angle of approximately 20° above horizontal rotating at 60 RPM's, together with an equal volume of glass beads of various sizes, as in Example 1. Then 24° C. water was added to the mixture with 30 grams of an inhibited acid solution containing 99.7 parts 66° Be sulfuric acid and 0.3 part Additive "R" and allowed to mix for two minutes. To the barrel contents, 12.9 grams of a mixture containing 43.9 parts 66° Be sulfuric acid, 23.1 parts cupric sulfate pentahydrate, and 33.0 parts sodium chloride, were added to promote a copper deposit.

After five minutes, 5.5 grams of a powder containing 56.4 parts sodium bisulfate, 5.4 parts Additive "R", 14.6 parts Carbowax 20M, and 23.6 parts cadmium sulfate were added to the barrel and allowed to mix for 2 minutes.

After mixing, 2 grams of zinc powder was added and mixed for 5 minutes to initiate and obtain a thin flash coating. Then 150 grams of zinc powder was added incrementally to the barrel, in ten 3 gram increments at one minute intervals, and eight 12.5 gram increments at 2.5 minute intervals. Each increment was added together with the following mixture based on the weight of zinc added:

Sodium Bisulfate: 13.44 grams/100 grams of zinc
Addition "R": 0.07 gram/100 grams of zinc
Carbowax 20M: 0.66 gram/100 grams of zinc
Cadmium Sulfate: 2.2 grams/100 grams of zinc After deposition of the metal powder, the resultant coating was found to be uniform in appearance and had excellent adhesion. The thickness was determined to be 2.8 mils (70$\mu$).

What is claimed is:

1. A mechanical plating process for providing metallic articles with a heavy, thick metallic coating of a mechanical plating metal, comprising the steps of:

(a) providing an acidic aqueous mixture of said metallic articles, impact media and a flash promoter, the acidity of the mixture being sufficient to remove metal oxides contained on the articles to be plated and on a finely divided mechanical plating metal to be added, said flash promoter comprising per 100 square feet of plating surface area, up to about 400 grams of a strong acid or an acid engendering salt, from about 10 to about 80 grams of a soluble salt of a metal more noble than said plating metal, an effective amount of a dispersant capable of dispersing said plating metal, and an effective amount of an inhibitor capable of inhibiting corrosion of said plating metal;

(b) adding to said mixture said finely divided mechanical plating metal in sufficient quantity to effect a galvanomechanical deposition of said metal more noble than said plating metal;

(c) agitating the resultant mixture until said deposition is effected;

(d) adding to said mixture a portion of finely divided mechanical plating metal and an effective amount of a continuing promoter, said continuing promoter comprising, per pound of finely divided mechanical plating metal, from about 20 to about 150 grams of a strong acid or an acid engendering salt, from about 1.0 to about 20 grams of a soluble salt of a metal more noble than said plating metal, an effective amount of a dispersant capable of dispersing said plating metal, and an effective amount of an inhibitor capable of inhibiting corrosion of said plating metal;

(e) agitating said mixture for a sufficient time to effect mechanical plating of said finely divided plating metal on said metallic articles; and (f) repeating steps (d) and (e) until said heavy, thick metallic coating is obtained on said metallic articles.

2. The process of claim 1 wherein said metal more noble than said plating metal is tin.

3. The process of claim 1 wherein said dispersant comprises a polyoxyethylene glycol having a cloud point in a 1 percent aqueous solution below 100° C.

4. The process of claim 3 wherein said polyoxyethylene glycol is contained at a concentration of less than about 40 grams, per 100 square feet of plating surface area, in said flash promoter, and less than about 8 grams, per pound of plating metal, in said continuing promoter.

5. The process of claim 1 wherein said finely divided mechanical plating metal is zinc.

* * * * *